US007486305B2

(12) United States Patent
Koll et al.

(10) Patent No.: US 7,486,305 B2
(45) Date of Patent: Feb. 3, 2009

(54) VARIABLE RESOLUTION OPTICALLY ADDRESSED ACTIVE DISPLAY

(75) Inventors: Andrew Koll, Albany, OR (US); Daryl E. Anderson, Corvallis, OR (US); George H Corrigan, III, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 729 days.

(21) Appl. No.: 10/818,856

(22) Filed: Apr. 5, 2004

(65) Prior Publication Data

US 2005/0219212 A1 Oct. 6, 2005

(51) Int. Cl.
*G09G 5/02* (2006.01)

(52) U.S. Cl. ..... 345/698; 345/690

(58) Field of Classification Search ..... 345/539, 345/98, 690, 204, 698; 348/734, 797
See application file for complete search history.

(56) References Cited

U.S. PATENT DOCUMENTS

| | | | | |
|---|---|---|---|---|
| 6,549,179 | B2 * | 4/2003 | Youngquist et al. | 345/39 |
| 2002/0015112 | A1 * | 2/2002 | Nagakubo et al. | 348/734 |
| 2003/0117347 | A1 * | 6/2003 | Hunter et al. | 345/76 |

* cited by examiner

*Primary Examiner*—Ricardo L Osorio

(57) ABSTRACT

A pixel cell is instructed to relay activation instructions to another pixel cell. The first pixel cell is instructed to activate. The activation instruction is relayed to the second pixel cell. The pixel cells are both activated.

27 Claims, 3 Drawing Sheets

VARIABLE RESOLUTION OPTICALLY ADDRESSED ACTIVE DISPLAY

FIELD OF THE INVENTION

This invention relates in general to display resolution and, more particularly, to activating pixels according to activation instructions of other pixels.

BACKGROUND OF THE INVENTION

Some displays require each pixel to be individually provided with activation instructions. Very high resolution color displays require a very high data rate in order to update each pixel in the display faster than is humanly perceivable. Typically, a display showing a moving image must be updated at least 30 times per second to appear smooth to the human eye.

It is not always possible to achieve a data rate within a display high enough to update the entire display 30 times per second. As a result, either the display must be updated slower than 30 times per second or less than the entire display must be used.

SUMMARY OF THE INVENTION

According to principles of the present invention, in one embodiment, a pixel cell is instructed to relay activation instructions to another pixel cell. The first pixel cell is instructed to activate. The activation instruction is relayed to the second pixel cell. The pixel cells are both activated.

DETAILED DESCRIPTION OF THE INVENTION

Figure 1:
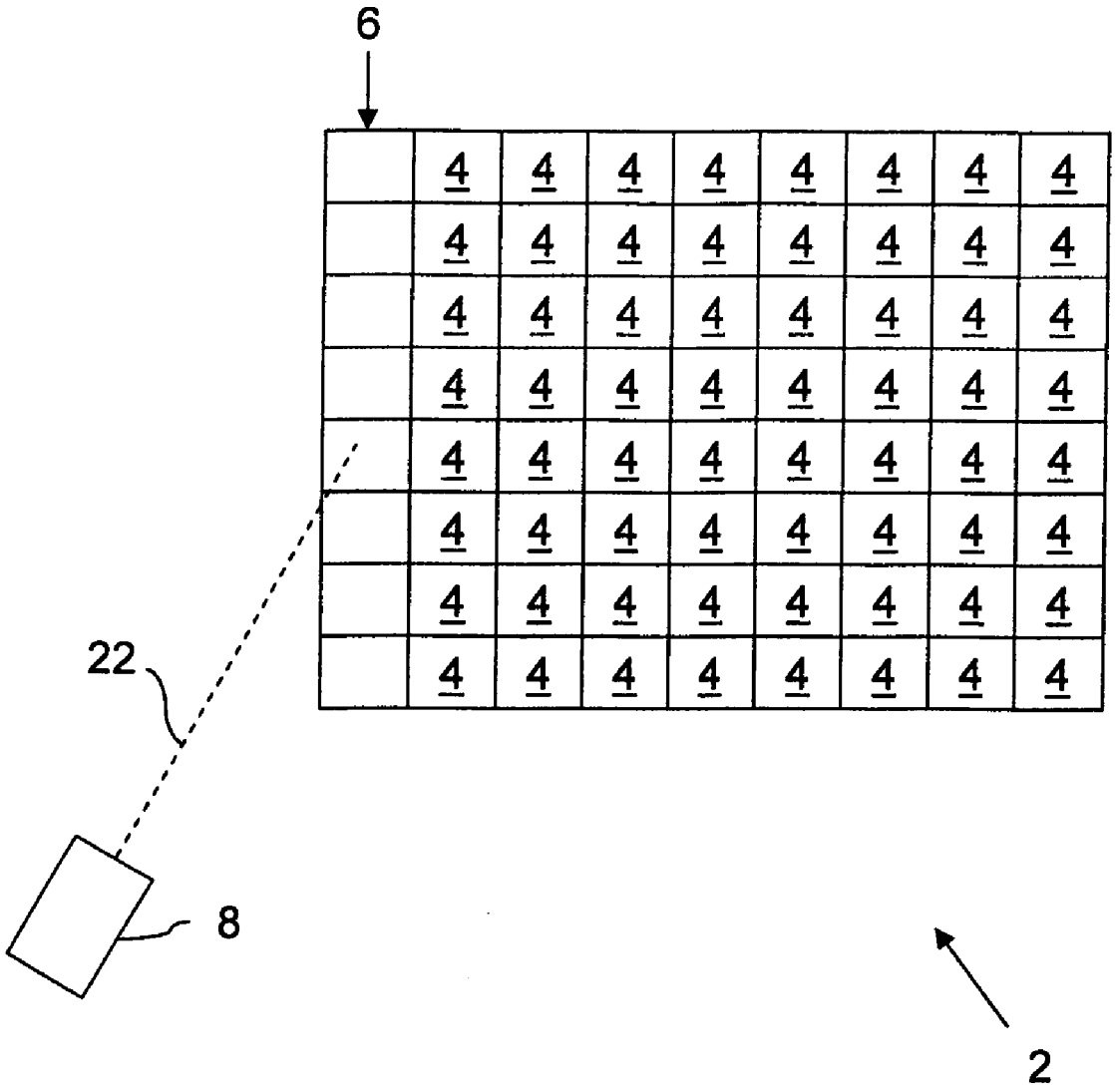
FIG. 1 is a depiction of one embodiment of the present invention display device.

Illustrated in FIG. 1 is one embodiment of a display device 2 of the present invention. Display device 2 is any display where each pixel is addressed individually. In one embodiment, display device 2 is an optically addressed display. In an alternate embodiment, display device 2 is a hardwired addressed display.

In one embodiment, display device 2 includes pixel cells 4, share selectors 6, and optionally beam projector 8. Pixel cells 4 cooperate to display an image on display device 2.

FIG. 1 shows pixel cells 4 arranged in a two-dimensional array having rows and columns. Alternatively, pixel cells 4 are arranged in any suitable layout. Pixel cells 4 are any combination of hardware and executable code suitable for producing controlled illumination of a pixel within display device 2.

Figure 2:
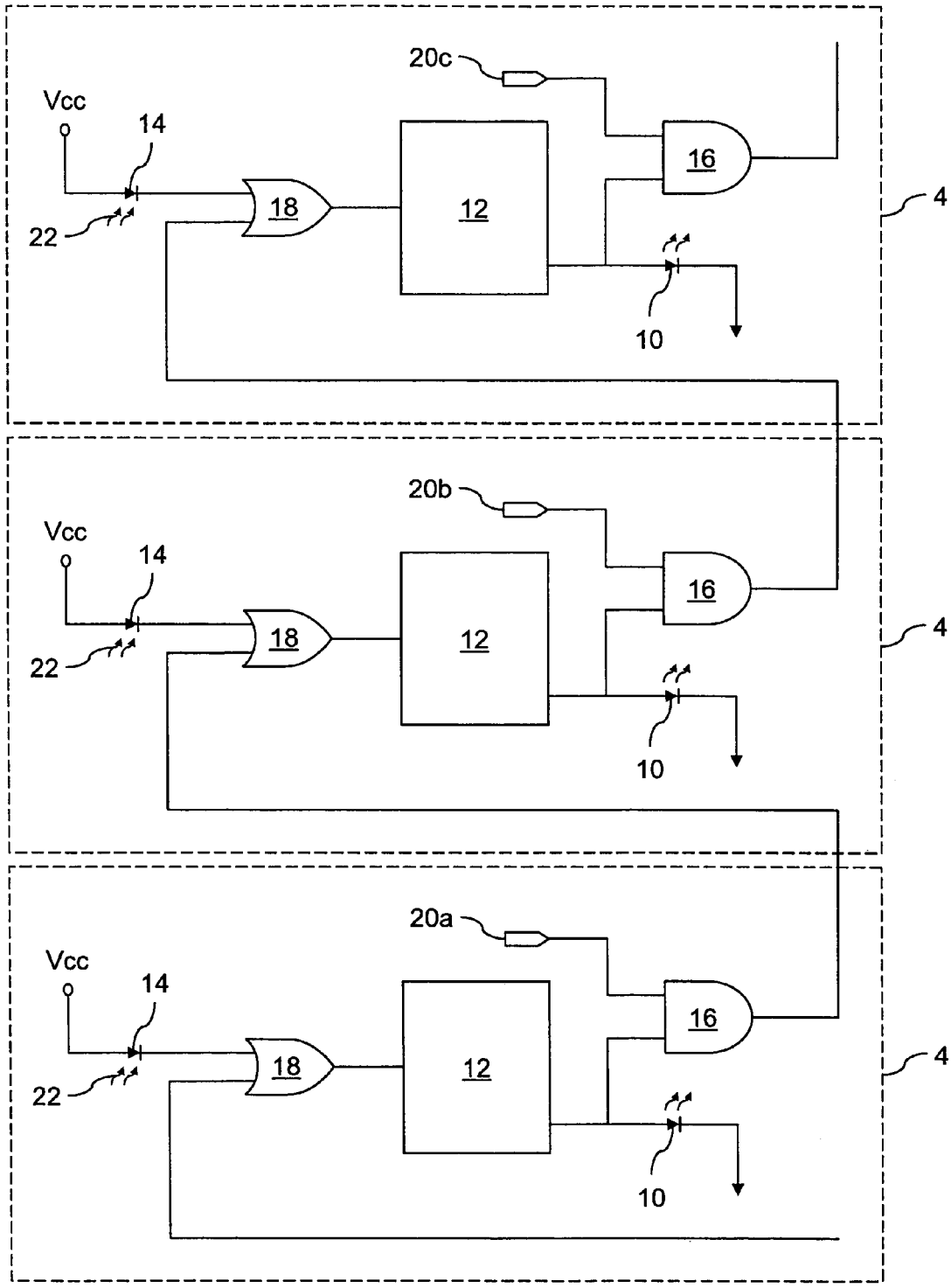
FIG. 2 represents a schematic diagram of a section of the pixel cells shown in FIG. 1.

FIG. 2 shows in more detail one embodiment, of a section of pixel cells 4. In one embodiment, pixel cells 4 each include light source 10, driver circuitry 12, and optionally receptor 14.

Light source 10 is any source of light suitable for forming a pixel. In one embodiment, light source 10 is a monochrome light source 10. In an alternate embodiment, light source 10 is a multicolor light source 10. In one embodiment, multicolor light source 10 includes a plurality of light controller elements. Examples of light controller elements include light emitters, such as light emitting diodes, light redirectors, such as mirrors, and light polarizers. For clarity, only a single monochrome light emitting diode is shown in FIG. 2.

Driver circuitry 12 is any suitable circuitry for driving light source 10. Driver circuitry 12 of pixel cells 4 are interconnected with driver circuitry 12 of other pixel cells 4 for selectively relaying activation instructions.

In one embodiment, an AND gate 16 and an OR gate 18 interconnect driver circuitry 12 of one pixel cell 4 with driver circuitry 12 of other pixel cells 4. A control signal is applied to one input 20*a*, 20*b*, or 20*c* of AND gate 16 to instruct pixel cell 4 to relay its activation instructions to another pixel cell 4. Should one pixel cell 4 be activated, the output of AND gate 16 is fed into OR gate 18, causing the pixel cell 4 immediately above to activate.

Alternatively, pixel cells 4 may be configured so that more than one other pixel cell 4 is activated upon activation of one pixel cell 4. Additionally, the pixel cell 4 activated upon activation of one pixel cell 4 need to be the pixel cell 4 immediately above the one pixel cell 4. Activation of a pixel cell 4 illuminates light source 10 of the pixel cell 4.

Receptor 14 is any device or system suitable for sensing a beam 22 projected from beam projector 8. Receptor 14 communicates with driver circuitry 12 and, when receptor 14 senses a beam projected from beam projector 8, activates pixel cell 4.

Share selectors 6 communicate with driver circuitry 12 of pixel cells 4. Share selectors 6 are any combination of hardware and executable code configured to produce a control signal for selectively initiating a relay of activation instructions from one pixel cell 4 to another pixel cell 4. Examples of share selectors 6 include control cells, logic devices, and charge storage devices. FIG. 1 illustrates share selectors 6 as control cells.

FIG. 1 shows control cells 6 arranged in a column adjacent pixel cells 4. Alternatively, control cells 6 are not arranged in a column. Additionally, control cells 6 need not be arranged adjacent pixel cells 4.

Beam projector 8 is any device or system configured to project a beam 22. Beam projector 8 is disposed to project a beam 22 towards pixel cells 4 and control cells 6. Beam 22 is any type of electromagnetic beam. Examples of types of beam 22 include infrared and visible light laser beams.

Figure 3:
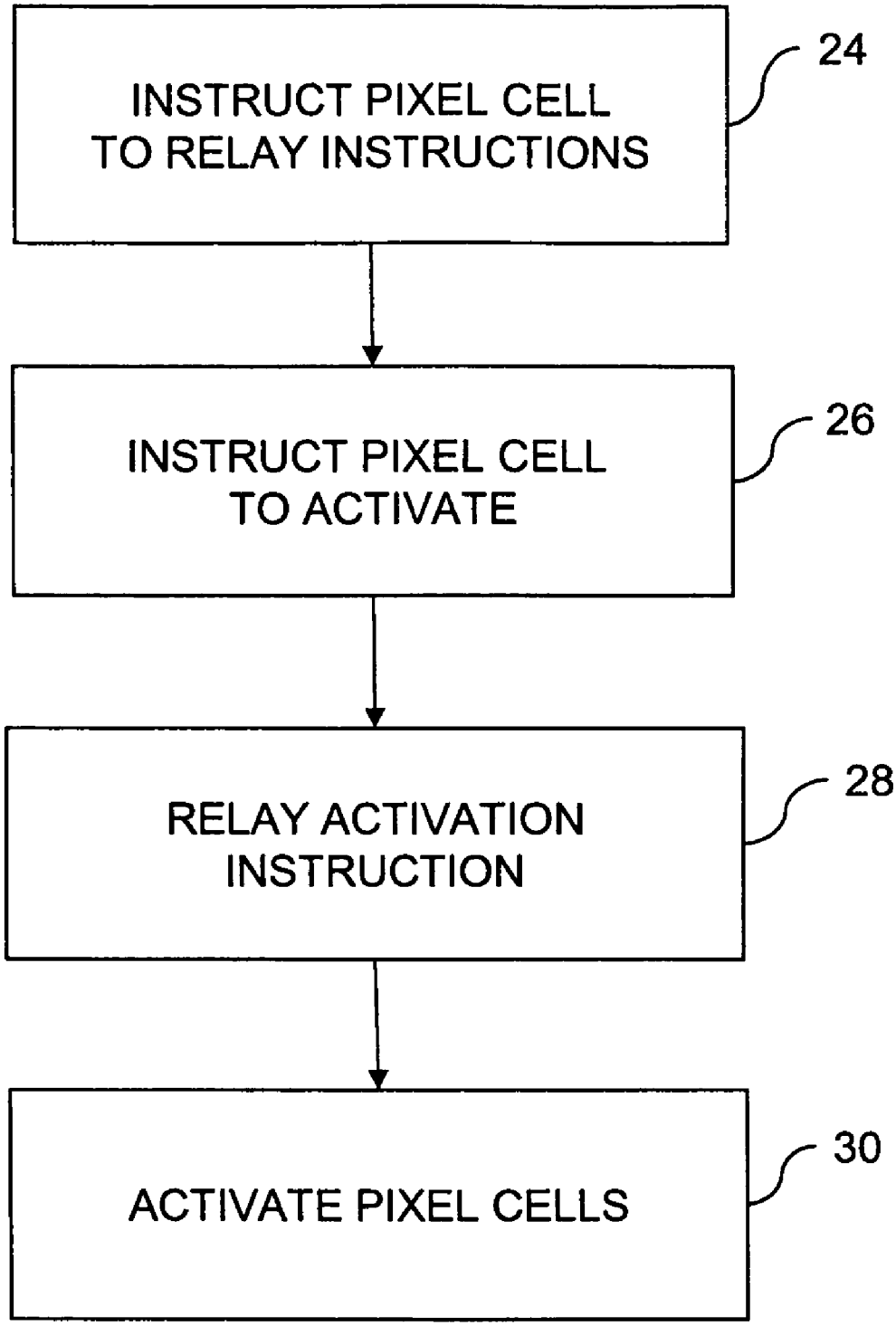
FIG. 3 is flow chart illustrating one embodiment of the present invention method for activating pixels.

FIG. 3 is a flow chart representing steps of one embodiment of the present invention. Although the steps represented in FIG. 3 are presented in a specific order, the present invention encompasses variations in the order of steps. Furthermore, additional steps may be executed between the steps illustrated in FIG. 3 without departing from the scope of the present invention.

A first pixel cell 4 is instructed (24) to relay activation instructions to a second pixel cell 4. In one embodiment, first pixel cell 4 and second pixel cell 4 are neighboring cells. In one example of this embodiment, a control cell 6 is activated for the row of the first pixel cell 4 to instruct (24) the first pixel cell 4 to relay activation instructions to a second pixel cell 4. In one embodiment, the control cell 6 is activated by scanning beam 22 across receptor 14 for the control cell 6.

The first pixel cell 4 is instructed (26) to activate. In one embodiment, the first pixel cell 4 is instructed (26) to activate by scanning beam 22 across receptor 14 for the first pixel cell 4.

The activation instruction is relayed (28) to the second pixel cell 4. The first and second pixel cells 4 are activated (30). In one embodiment, when the first and second pixel cells 4 are activated (30), light sources 10 of the first and second pixel cells 4 are illuminated.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. A method for activating pixels to display the pixels in variable resolutions, the method comprising:

in a first independent mode of resolution, instructing a first pixel cell to relay activation instructions to a second pixel cell, instructing the first pixel cell to activate, relay wherein the instruction to activate the first pixel cell activates the first and second pixel cells to display a first pixel having both the first and second pixel cells; and in a second independent mode of resolution, separately instructing the first pixel cell to activate, wherein the separate instruction to activate the first pixel cell activates the first pixel cell to display a second pixel having the first pixel cell, wherein the second pixel does not contain the second pixel cell; and in a third independent mode of resolution, separately instructing the second pixel cell to activate, wherein the separate instruction to activate the second pixel cell activates the second pixel cell to independently display a third pixel having the second pixel cell, wherein the third pixel cell does not contain the first pixel cell.

2. The method of claim 1 wherein the first pixel cell and second pixel cells are neighboring cells.

3. The method of claim 1 wherein the first pixel cell and the second pixel cell are arranged in a grid and the first and second pixel cells are in a common column and wherein instructing the first pixel cell in the first independent mode of resolution includes activating a control cell for the row of the first pixel cell.

4. The method of claim 3 wherein activating the control cell includes scanning an activation beam across a receptor for the control cell.

5. The method of claim 1 wherein the first pixel cell and the second pixel cell are arranged in a grid and the first and second pixel cells are in a common row and wherein instructing the first pixel cell in the first independent mode of resolution includes activating a control cell for the row of the first pixel cell.

6. The method of claim 5 wherein activating the control cell includes scanning an activation beam across a receptor for the control cell.

7. The method of claim 1 wherein separately instructing the first pixel cell to activate in the second independent mode of resolution includes scanning an activation beam across a receptor for the first pixel.

8. The method of claim 1 wherein each pixel cell includes a light source and wherein activating the first and second pixel cells in the first independent mode of resolution includes illuminating the light sources of the first and second pixel cells.

9. A display device having pixels displayable in variable resolutions comprising:

first and second pixel cells each having a light source and driver circuitry, the driver circuitry of the first pixel cell interconnected with the driver circuitry of the second pixel cell, wherein the second pixel cell is configured to selectively become activated when the first pixel cell is activated to cause a first pixel to contain the first and second pixel cells in a first independent mode of resolution;

wherein the second pixel cell is configured to selectively remain inactive when the first pixel cell is activated to cause a second pixel to contain the first pixel cell without the second pixel cell in a second independent mode of resolution;

wherein the second pixel cell is configured to selectively remain activated to cause a third pixel to contain the second pixel cell without the first pixel cell in a third independent mode of resolution;

wherein activation of each pixel cell illuminates the light source of each cell; and a share selector in communication with the driver circuitry of the first pixel cell, wherein activation of the share selector together with an instruction to activate the first pixel cell is operable to activate the first pixel cell so that the instruction to activate the first pixel cell activates the first and second pixel cells to display the first pixel in the first independent mode of resolution.

10. The display device of claim 9 wherein the share selector is a control cell.

11. The display device of claim 9 wherein the light sources of the first and second pixel cells are monochrome light sources.

12. The display device of claim 9 wherein the light sources of the first and second pixel cells are multicolored light sources.

13. The display device of claim 9 wherein the light sources of the first and second pixel cells are adjacent.

14. The display device of claim 9 wherein the first pixel cell and the second pixel cell are arranged in a grid and the first and second pixel cells are in a common column.

15. The display device of claim 9 wherein the first pixel cell and the second pixel cell are arranged in a grid and the first and second pixel cells are in a common row.

16. The display device of claim 9 further including a beam projector and wherein the pixel cells each further include a receptor in communication with the driver circuitry of the pixel cells and wherein for each pixel cell, the receptor sensing a beam projected from the beam projector activates the pixel cell.

17. A display device having pixels displayable in variable resolutions comprising:

first and second pixel cells, wherein the second pixel coil is configured to selectively become activated when the first pixel cell is activated and to cause a first pixel to contain the first and second pixel cells in a first independent mode of resolution, to cause a second pixel to contain the first pixel cell without the second pixel cell in a second independent mode of resolution, and to cause a third pixel to contain the second pixel cell without the first pixel cell in a third independent made of resolution, means for instructing the first pixel cell, wherein the means for instructing the first pixel cell is configured to relay activation instructions to the second pixel cell to cause the first and second pixel cells to illuminate in the first independent mode of resolution, and means for instructing the second pixel cell, wherein the means far instructing the second pixel is configured to selectively cause the second pixel cell to illuminate separately from the first pixel cell in the third independent mode of resolution.

18. The display device of claim 17 wherein the means for instructing the first pixel cell to relay activation instructions includes each pixel cell having driver circuitry and a control cell in communication with the driver circuitry of the first pixel cell, wherein activation of the control cell initiates a relay of activation instructions from the first pixel cell to the second pixel cell.

19. The display device of claim 17 wherein the means for instructing the first pixel cell to activate includes a beam projector and wherein the first pixel cell includes driver circuitry and a receptor in communication with the driver circuitry and wherein the receptor sensing a beam projected from the beam projector activates the first pixel cell, instructing the first pixel cell to activate.

20. The display device of claim 17 wherein the means for relaying the activation instruction includes each pixel cell having driver circuitry and the driver circuitry of the first pixel cell interconnected with the driver circuitry of the second pixel cell for selectively relaying activation instructions.

21. The display device of claim 17 wherein the means for activating the first and second pixel cells includes each pixel cell having a light source and driver circuitry, wherein activation of the driver circuitry for each pixel cell illuminates the light source of each cell.

22. The display device of claim 21 wherein the light sources of the first and second pixel cells are monochrome light sources.

23. The display device of claim 21 wherein the light sources of the first and second pixel cells are multicolored light sources.

24. The display device of claim 21 wherein the light sources of the first and second pixel cells are adjacent.

25. The display device of claim 17 wherein the first pixel cell and the second pixel cell are neighboring cells.

26. The display device of claim 17 wherein the first pixel cell and the second pixel cell are arranged in a grid and the first and second pixel cells are in a common column.

27. The display device of claim 17 wherein the first pixel cell and the second pixel cell are arranged in a grid and the first and second pixel cells are in a common row.

* * * * *

UNITED STATES PATENT AND TRADEMARK OFFICE

CERTIFICATE OF CORRECTION

PATENT NO. : 7,486,305 B2
APPLICATION NO. : 10/818856
DATED : February 3, 2009
INVENTOR(S) : Andrew Koll et al.

It is certified that error appears in the above-identified patent and that said Letters Patent is hereby corrected as shown below:

In column 3, line 14, in Claim 1, before “wherein” delete “relay”.

In column 3, line 33, in Claim 2, delete “pixel cells” and insert -- pixel cell --, therefor.

In column 4, line 47, in Claim 17, delete “coil” and insert -- cell --, therefor.

In column 4, line 55, in Claim 17, delete “made” and insert -- mode --, therefor.

In column 4, line 62, in Claim 17, delete “far” and insert -- for --, therefor.

Signed and Sealed this

Twenty-sixth Day of May, 2009

JOHN DOLL
*Acting Director of the United States Patent and Trademark Office*